US005924061A

United States Patent [19]

Shoham

[11] Patent Number: 5,924,061

[45] Date of Patent: Jul. 13, 1999

[54] EFFICIENT DECOMPOSITION IN NOISE AND PERIODIC SIGNAL WAVEFORMS IN WAVEFORM INTERPOLATION

[75] Inventor: Yair Shoham, Watchung, N.J.

[73] Assignee: Lucent Technologies Inc., Murray Hill, N.J.

[21] Appl. No.: 08/813,183

[22] Filed: Mar. 10, 1997

Related U.S. Application Data

[51] Int. Cl.[6] ..... G10L 3/02; G10L 9/00

[52] U.S. Cl. ..... 704/218; 704/219; 704/203

[58] Field of Search ..... 704/218, 219, 704/203

[56] References Cited

U.S. PATENT DOCUMENTS 5,517,595 5/1996 Kleijn ..... 395/2.14

OTHER PUBLICATIONS

M. Unser, A. Aldroubi, and M. Eden, "B–Spline Signal Processing: Part I—Theory," *IEEE Transactions on Signal Processing*, vol. 41, No. 2, Feb. 1993, pp. 821–833.

M. Unser, A. Aldroubi, and M. Eden, "B–Spline Signal Processing: Part II—Efficient Design and Applications," *IEEE Transactions on Signal Processing*, vol. 41, No. 2, Feb. 1993, pp. 834–848.

H. S. Hou and H. C. Andrews, "Cubic Splines for Image Interpolation and Digital Filtering," *IEEE Transactions on Acoustics, Speech, and Signal Processing*, vol. ASSP–26, No. 6, Dec. 1978, pp. 508–517.

J. C. Hardwick and J. S. Lim, "The Application of the IMBE Speech Coder to Mobile Communications," *Proceedings of ICASSP–1991*, (CH2977–7/91/0000–0249 1991 IEEE S4, 13), pp. 249–252.

A. V. McCree and T. P. Barnwell III, "A Mixed Excitation LPC Vocoder Model for Low Bit Rate Speech Coding," *IEEE Transactions on Speech and Audio Processing*, vol. 3, No. 4, Jul. 1995, pp. 242–250.

D. H. Pham and I. S. Burnett, "Quantisation Techniques for Prototype Waveforms," *International Symposium on Signal Processing and its Applications*, ISSPA, Gold Coast, Australia, 25–30 Aug., 1996, 4 pages.

I. S. Burnett and G. J. Bradley, "New Techniques for Multi–Prototype Waveform Coding at 2.84b/s," *Proceedings of ICASSP–1995*, (0–7803–2431–5/95 1995 IEEE), pp. 261–264.

W. B. Kleijn and J. Haagen, "A Speech Coder Based on Decomposition of Characteristic Waveforms," *Proceedings of ICASSP—1995*, (0–7803–2431–5/95 1995 IEEE), pp. 508–511.

(List continued on next page.)

*Primary Examiner*—David R. Hudspeth
*Assistant Examiner*—Robert Louis Sax
*Attorney, Agent, or Firm*—Kenneth M. Brown

[57] ABSTRACT

A low-complexity method and apparatus for performing signal decomposition in a low bit-rate WI speech encoder. A time-ordered sequence of sets of time-domain parameters is generated based on samples of a speech signal to be coded, each set of time-domain parameters corresponding to a waveform characterizing the speech signal. A cross correlation is then performed between two or more of said sets of time-domain parameters to produce a set of signals which represents relatively high rates of evolution of characterizing waveform shape across the time-ordered sequence of sets. Finally, the speech signal is coded based on the produced set of signals. A set of signals which represents relatively low rates of evolution of characterizing waveform shape across the time-ordered sequence of sets may also be produced. In this case, a time-ordered sequence of sets of frequency-domain parameters is also generated based on the samples of the speech signal to be coded, and an average of two or more of these sets of frequency-domain parameters is then computed. A set of signals which represents relatively low rates of evolution of characterizing waveform shape across the time-ordered sequence of sets is then produced based on the computed average, and the speech signal is then coded further based on this produced set of signals as well.

20 Claims, 3 Drawing Sheets

OTHER PUBLICATIONS

W. B. Kleijn, Y. Shoham, D. Sen, and R. Hagen, "A Low–Complexity Waveform Interpolation Coder," *Proceedings of ICASSP–1996*, (0–7803–3192–3/96 1996 IEEE), pp. 212–215, May 7–10.

Y. Shoham, "High–Quality Speech Coding at 2.4 KBPS Based on Time–Frequency Interpolation," *Proceedings of ICASSP–1993*, pp. 741–744.

Y. Shoham, "High–Quality Speech Coding at 2.4 to 4.0 KBPS Based on Time–Frequency Interpolation," *Proceedings of ICASSP–1993*, vol. 2, Apr. 1993, (0–7803–0946–4/93 1993 IEEE), pp. 167–170.

J. Zhou et al., "Simple fast vector quantization of the line spectral frequencies," *Proc. ICSLP'96*, vol. 2, Oct. 1996, pp. 945–948.

EFFICIENT DECOMPOSITION IN NOISE AND PERIODIC SIGNAL WAVEFORMS IN WAVEFORM INTERPOLATION

CROSS-REFERENCE TO RELATED APPLICATION

The subject matter of the present application is related to that of U.S. Pat. No. 5,517,595, issued to W. B. Kleijn on May 14, 1996, entitled "Decomposition in Noise and Periodic Signal Waveforms in Waveform Interpolation," which is hereby incorporated by reference as if fully set forth herein.

The subject matter of the present application is also related to the U.S. Patent Application of Y. Shoham entitled "Waveform Interpolation Speech Coding Using Splines," filed on even date herewith and assigned to the assignee of the present invention.

FIELD OF THE INVENTION

The present invention relates generally to the field of low bit-rate speech coding, and more particularly to a method and apparatus for performing low bit-rate speech coding with reduced complexity.

BACKGROUND OF THE INVENTION

Communication of speech information often involves transmitting electrical signals which represent speech over a channel or network ("channel"). A problem commonly encountered in speech communication is how to transmit speech through a channel of limited capacity or bandwidth. (In modern digital communications systems, bandwidth is often expressed in terms of bit-rate.) The problem of limited channel bandwidth is usually addressed by the application of a speech coding system, which compresses a speech signal to meet channel bandwidth requirements. Speech coding systems include an encoder, which converts speech signals into code words for transmission over a channel, and a decoder, which reconstructs speech from received code words.

As a general matter, a goal of most speech coding systems concomitant with that of signal compression is the faithful reproduction of original speech sounds, such as, e.g, voiced speech. Voiced speech is produced when a speaker's vocal cords are tensed and vibrating quasi-periodically. In the time domain, a voiced speech signal appears as a succession of similar but slowly evolving waveforms referred to as pitch-cycles. Each pitch-cycle has a duration referred to as a pitch-period. Like the pitch-cycle waveform itself, the pitch-period generally varies slowly from one pitch-cycle to the next.

Many speech coding systems which operate at bit-rates around 8 kilobits per second (kbps) code original speech waveforms by exploiting knowledge of the speech generation process. Illustrative of these so-called waveform coders are the code-excited linear prediction (CELP) speech coding systems, which code a speech waveform by filtering it with a time-varying linear prediction (LP) filter to produce a residual speech signal. During voiced speech, the residual signal comprises a series of pitch-cycles, each of which includes a major transient referred to as a pitch-pulse and a series of lower amplitude vibrations surrounding it. The residual signal is represented by the CELP system as a concatenation of scaled fixed-length vectors from a codebook. To achieve a high coding efficiency of voiced speech, most implementations of CELP also include a long-term predictor (or adaptive codebook) to facilitate reconstruction of a communicated signal with appropriate periodicity. Despite improvements over time, however, many waveform coding systems suffer from perceptually significant distortion when operating at rates below 6 kb/s. This distortion is typically characterized as noise.

Specifically, waveform coders operate by coding speech using waveforms which serve to characterize the speech signal to be coded. These waveforms are referred to as characterizing waveforms. A characterizing waveform is a signal of a length which is typically at least one pitch-period (see above), and where the pitch-period is defined to be the output of a pitch detection process. (Note that a pitch detection process may be used so that it always supplies a pitch-period even for speech signals without obvious periodicity—for unvoiced speech, such a pitch-period is essentially arbitrary.) An illustrative characterizing waveform may be formed based on the output of a linear predictive (LP) filter which operates on an original speech signal (which signal is to be coded). As explained above, this output is referred to as the residual signal.

Low bit-rate coding systems which operate, for example, at rates of 2.4 kb/s are generally parametric in nature. That is, they operate by transmitting parameters describing pitch-period and the spectral envelope (or formants) of the speech signal at regular intervals. Illustrative of these so-called parametric coders is the LP vocoder system. LP vocoders model a voiced speech signal with a single pulse per pitch period. This basic technique may be augmented to include transmission information about the spectral envelope, among other things. Although LP vocoders provide reasonable performance generally, they also may introduce perceptually significant distortion, typically characterized as buzziness.

The types of distortion discussed above, and another—reverberation—common in sinusoidal coding systems, are generally the result of a reconstructed speech signal which lacks (in whole or in significant part) the pitch-cycle dynamics found in original voiced speech. Naturally, these types of distortion are more pronounced at lower bitrates, as the ability of speech coding systems to code information about speech dynamics decreases. These problems have been addressed, and significant progress has recently been achieved in low-rate speech coding, with the introduction of algorithms based on waveform interpolation and associated signal modeling techniques. The general idea behind these techniques is to try to synthesize a coded signal that mimics the natural evolution of the original speech, while sending as little information as possible about the original signal. This idea is based on the observation that speech usually carries slowly varying attributes that may be sampled and interpolated at low rates. A significant amount of information in the signal can be discarded, as long as certain key features are faithfully regenerated.

The main techniques used in accomplishing this task are waveform interpolation (WI) and signal decomposition (SD). WI is used in the synthesis process (i.e., in the decoder) to maintain the degree of smoothness usually observed in speech signal, particularly in voiced regions. Maintaining smoothness increases the robustness to coding distortions. As an example, larger errors in pitch can be perceptually tolerated if the pitch varies smoothly rather than abruptly (unnaturally). The same is true for other types of distortions. SD enables the coding system to focus on the more important signal domains, discarding information carried in less important ones. WI coders are described, for example, in Y. Shoham, "High-quality speech coding at 2.4 to 4.0 kbps based on time-frequency interpolation," Proc. ICASSP '93 pp. II167–170; Y. Shoham, "High-quality speech coding at 2.4 kbps based on time-frequency interpolation," Proc. Eurospeech '93, pp. 741–744; W. B. Kleijn et al., "A speech coder based on decomposition of characteristic waveforms," Proc. ICASSP '95 pp. 508–511; and W. B. Kleijn et al., "A low-complexity waveform interpolation coder," Proc. ICASSP '96, pp. 212–215. WI coders are also described in the above referenced commonly assigned U.S. patent application "Method and Apparatus for Prototype Waveform Speech Coding," Ser. No. 08/667,295, and in commonly owned U.S. Pat. No. 5,517,595, entitled "Decomposition in Noise and Periodic Signal Waveforms in Waveform Interpolation," issued to W. B. Kleijn on May 14, 1996, which patent is hereby incorporated by reference as if fully set forth herein.

Although WI coders generally produce reasonably good quality reconstructed speech at low bit rates, the complexity of these prior art coders is often too high to be commercially viable for use, for example, in low-cost terminals. Therefore, it would be desirable if a WI coder were available having substantially less complexity than that of prior art WI coders, while maintaining an adequate level of performance (i.e., with respect to the quality of the reconstructed speech).

SUMMARY OF THE INVENTION

In accordance with the present invention, an improved, low-complexity method and apparatus for performing signal decomposition in a low bit-rate WI speech encoder is provided. Specifically, a time-ordered sequence of sets of time-domain parameters is generated based on samples of a speech signal to be coded, each set of time-domain parameters corresponding to a waveform characterizing the speech signal. A cross correlation is then performed between two or more of said sets of time-domain parameters to produce a set of signals which represents relatively high rates of evolution of characterizing waveform shape across the time-ordered sequence of sets. (This produced set of signals may be referred to as the "random spectrum" or the "unstructured" component.) Finally, the speech signal is coded based on the produced set of signals (i.e., the unstructured component).

In accordance with one illustrative embodiment of the present invention, a set of signals which represents relatively low rates of evolution of characterizing waveform shape across the time-ordered sequence of sets may also be produced. In this case, a time-ordered sequence of sets of frequency-domain parameters is also generated based on the samples of the speech signal to be coded, and an average of two or more of these sets of frequency-domain parameters is then computed. A set of signals which represents relatively low rates of evolution of characterizing waveform shape across the time-ordered sequence of sets is then produced based on the computed average, and the speech signal is then coded further based on this produced set of signals as well. (This latter produced set of signals may be referred to as the "average spectrum" or the "structured" component.)

DETAILED DESCRIPTION

A. Overview of Waveform Interpolation

The WI method is based on processing a time sequence of spectra. A spectrum in such a sequence may, for example, be a phase-relaxed discrete Fourier transform (DFT) of a pitch-long snapshot of the speech signal. Moreover, the phase of the spectrum may be subjected to a circular shift. Snapshots are taken at update intervals which, in principle, may be as short as one sample. These update intervals can be totally pitch-independent, but, for the sake of efficient processing, they are preferably dynamically adapted to the pitch period.

The WI process can be illustratively described as follows. Let S(t,K) be a DFT of a snapshot at time t, with a time-varying pitch period P(t). The inverse DFT (IDFT) of S(t,K), denoted by U(t,c), is taken with respect to a constant DFT basis function support of size t seconds. This is known as time scale normalization, familiar to those skilled in the art. With this normalization, U(t,c) may be viewed as a periodic function, with a period T, along the axis c. When two consecutive snapshots are taken at $t_0$ and $t_1$, $S(t_1,K)$ is advantageously aligned to $S(t_0,K)$ by a circular shift for maximum correlation. Therefore, if the pitch signal is slowly varying, the two-dimensional surface U(t,c) is smooth along the t axis. This situation is illustratively depicted in FIG. 1, where all the waveforms have same period T along c and are slowly varying along the t axis. In reality, the surface U(t,c) is not given at any particular point but rather at boundary waveforms $U(t_0,c)$ and $U(t_1,c)$ corresponding to the spectra $S(t_0,K)$, $S(t_1,K)$. Values in between are advantageously interpolated from these spectra as described below. The variable "c" in U(t,c) represents the number of normalized pitch cycles. For a speech signal, it is a function of time, denoted by c(t), and given by $$c(t) = T\int^{t} \frac{1}{P(v)}\,dv \tag{1}$$

Given the cycle value at time t, a one-dimensional signal s(t) is generated by sampling the surface at the points (t,c(t)), that is, $$s(t)=U(t,c(t)) \tag{2}$$

Figure 1:
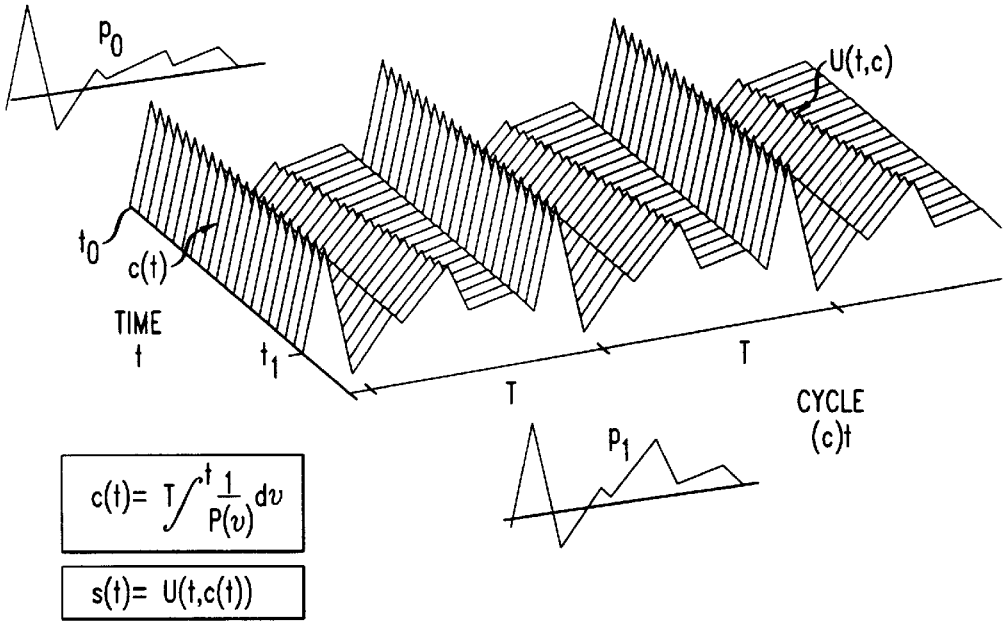
FIG. 1 shows a surface comprising a series of smoothly evolving waveforms as may be advantageously produced by a waveform interpolation coder.

As illustratively shown in FIG. 1, s(t) is generated by sampling U(t,c) along the path defined by c(t), namely, at locations (t,c(t)). The complete surface U(t,c) is shown in FIG. 1 only for illustrative purposes. In practice, it is usually not necessary to generate (i.e., interpolate) the entire surface prior to sampling. Only those values on the sampling path (t, c(t)) are advantageously determined by computing:

$$s(t) = U(t, c(t)) = \sum_{K} S(t, K)e^{j\frac{2\pi K}{T}c(t)} \tag{3}$$

where the spectrum S(t,K) is interpolated from the two boundary spectra:

$$S(t,k)=\alpha(t)S(t_0,K)+\beta(t)S(t_1,K)\,t_0<t<t_1 \tag{4}$$

The functions $\alpha(t)$ and $\beta(t)$ may, for example, represent linear interpolation, but other interpolation rules may be alternatively employed, such as, in particular, one that interpolates the spectral magnitude and phase separately. The cycle function c(t) is also advantageously obtained by interpolation. First, the pitch function P(t) is interpolated from its boundary values $P(t_0)$ and $P(t_1)$ and then, equation (1) above is computed for $t_0<t<t_1$.

Assuming faithful transmission of the update spectra, the signal s(t) has most of the important characteristics of the original speech. In particular, its pitch track follows the original one even though no pitch synchrony has been used and the update times may have been pitch independent. This implies a great deal of information reduction which is advantageous for low rate coding.

In non-periodic (unvoiced) speech segments, the pitch may be set to whatever essentially arbitrary value is computed by the encoder's pitch detector and does not, therefore, represent a real pitch cycle. Moreover, the resultant pitch value may be advantageously modified in order to smooth the pitch track. Such a pitch may be used by the system in the same way, regardless of its true nature. This approach advantageously eliminates voicing classification and provides for robust processing. Note that even in this case (in fact, for any signal), the interpolation framework described above works well whenever the update interval is less than half the pitch period.

B. Overview of Signal Decomposition in a WI Coder

A WI encoder typically analyzes and decomposes the speech signal for efficient compression. In particular, the signal decomposition is advantageously performed on two levels. On the first level, standard 10th-order LPC analysis may be performed once per frame over frames of, for example, 25 msec to obtain spectral envelope (LPC) parameters and an LP residual signal. Splitting the signal in this manner allows for perceptually efficient quantization of the spectrum. While a fairly accurate coding of the spectral envelope is preferable for producing high quality reconstructed speech, significant distortions of the fine-structured LP residual spectrum can often be tolerated, especially at higher frequencies. In view of this, the residual signal advantageously undergoes a 2nd-level decomposition, the purpose of which is to split the signal into structured and unstructured components. The structured signal is essentially periodic whereas the unstructured one is non-periodic and essentially random (i.e., noise-like).

Although many advanced low-rate speech coders use this sort of basic decomposition, differing in methods and mechanics, in most WI coders, the 2nd-level decomposition is performed using the notions of slowly evolving waveforms (SEW) and rapidly evolving waveforms (REW). (See, e.g., W. B. Kleijn et al., "A speech coder based on decomposition of characteristic waveforms," and U.S. Pat. No. 5,517,595, each referenced above.) This approach is based on the observation that in voiced (i.e., mostly periodic) speech segments, acoustic features like pitch and spectral parameters evolve rather slowly, whereas these features evolve much faster in unvoiced segments. Therefore, it may be assumed that if the signal is split into SEW and REW components, the SEW mostly represents a periodic component whereas the REW mostly represents an aperiodic noise-like signal. This decomposition may be advantageously performed in the LP residual domain. For this purpose the update snapshots of the residual may be obtained by taking pitch-size DFT's at times $t_n$, thereby yielding the spectra $R(t_n, K)$. The speech spectra are, therefore, given by $$S(t_n,K)=A(t_n,K)R(t_n,K) \tag{5}$$

where $A(t_n, K)$ is the LPC spectrum at time $t_n$.

The SEW sequence may be obtained by filtering each spectral component (ie., for each value of K) of $R(t_n, K)$ along the temporal axis using, for example, a 20 Hz, 20-tap lowpass filter. This results in a sequence of SEW spectra, $SEW(t_n, K)$, which may then be advantageously downsampled to, for example, one SEW spectrum per frame. By using a complementary highpass filter, the sequence of REW spectra, $REW(t_n, K)$ may be similarly obtained. Since the spectral snapshots are usually not taken at exact pitch-cycle intervals, the spectra $S(t_n)$ are advantageously aligned prior to filtering. This alignment may, for example, comprise high-resolution phase adjustment, equivalent to a time-domain circular shift, which advantageously maximizes the correlation between the current and previous spectra. This eliminates artificial spectral variations due to phase mismatches.

An interesting observation is that unlike many other decomposition methods, this decomposition is (at least in principle) loss less and reversible—namely, the original (aligned) sequence $R(t_n, K)$ can be recovered. Thus, this method does not force a ceiling on the coding performance. If the SEW and the REW are coded at sufficiently high bit rates, very high quality speech can be reconstructed by a conventional WI decoder (since the entire residual signal can be accurately reconstructed). The spectra $R(t_n, K)$ are advantageously normalized to have a unit average root-mean-squared (RMS) value across the K axis. This removes level fluctuations, enhances the SEW/REW analysis and make it easier to quantize the REW and the SEW. The RMS level (i.e., the gain) may be quantized separately. This also allows the system to take special care of perceptually important changes in signal levels (e.g., onsets), independently of other parameters.

C. A Conventional Waveform Interpolation Coder

Figure 2:
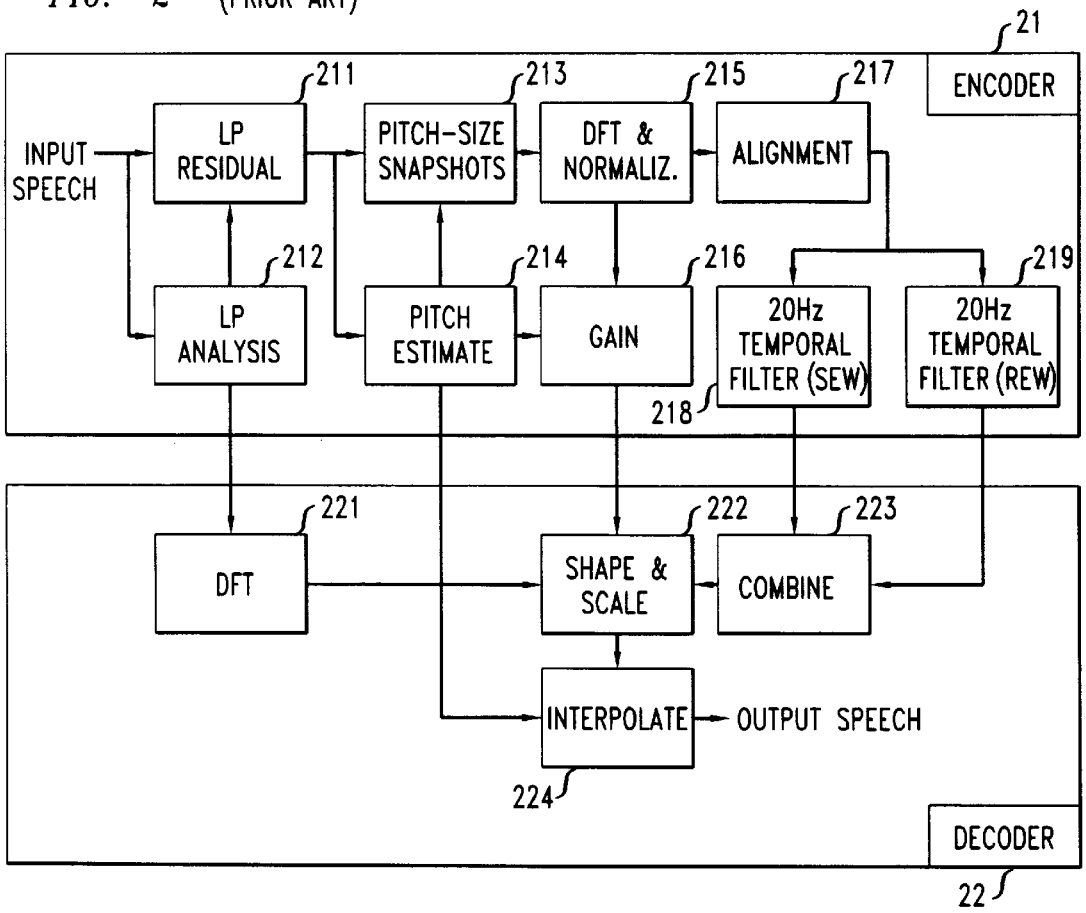
FIG. 2 (PRIOR ART)
FIG. 2 shows a block diagram of a conventional waveform interpolation coder.

FIG. 2 shows a block diagram for a conventional WI coder comprising encoder 21 and decoder 22. At the encoder, LP analysis (block 212) is applied to the input speech and the LP filter is used to get the LP residual (block 211). Pitch estimator 214 is applied to the residual to get the current pitch period. Pitch-size snapshots (block 213) are taken on the residual, transformed by a DFT and normalized (block 215). The resulting sequence of spectra is first aligned (block 217) and then filtered along the temporal axis to form the SEW (block 218) and the REW (block 219) signals. These are quantized and transmitted along with the pitch LP coefficients (generated by block 212) and the spectral gains (generated by block 216).

At the decoder, the coded REW and SEW signals are decoded and combined (block 223) to form the quantized excitation spectrum $\hat{R}(t_n, K)$. The spectrum is then reshaped by the LPC spectral envelope and re-scaled by the gain to the proper RMS level (block 222), thereby producing the quantized speech spectra $\hat{S}(t_n, K)$. These spectra are now interpolated (block 224) as described above to form the final reconstructed speech signal.

The WI coder of FIG. 2 is capable of delivering high quality speech as long as ample bit resources are made available for coding all the data, especially the REW and the SEW signals. Note that the REW/SEW representation is, in principle, an over-sampled one, since two full-size spectra are represented. This puts an extra burden on the quantizers. At low bit rates, bits are scarce and the REW/SEW representation is typically severely compromised to allow for a meaningful quantization, as further described below. For example, a typical conventional WI coder operating at a rate of 2.4 kbps uses a frame size of 25 msec and is therefore limited to employing a bit allocation typically consisting of 30 bits for the LPC data, 7 bits for the pitch information, 7 bits for the SEW data, 6 bits for the REW data, and 10 bits for the gain information. Similarly, a typical conventional WI coder operating at a rate of 1.2 kbps uses a frame size of 37.5 msec and is therefore limited to employing a bit allocation typically consisting of 25 bits for the LPC data, 7 bits for the pitch information, no bits for the SEW data, 5 bits for the REW data, and 8 bits for the gain information. (Note that in the 1.2 kbps case, an overall flat LP spectrum is assumed, and the SEW signal is then presumed to be the portion thereof which is complementary to the REW signal portion which has been coded.)

Interpolative coding as described above is computationally complex. Some early WI coders actually ran much slower then real time. An improved lower-complexity WI coder was proposed by W. B. Kleijn et al. in "A low-complexity waveform interpolation coder," cited above, but much lower complexity coders are needed to provide for commercially viable alternatives in a broad range of applications. Specifically, it is desirable that only a small fraction of a processor's computational power is used by the coder, so that other tasks, such as, for example, networking, can be performed uninterruptedly.

Note that in a typical WI coder, the main contributors to the computational load are the signal decomposition and the interpolation processes. Other significant contributors are the pitch tracking, the spectral alignment and the LPC quantization procedures. Memory usage is also an important factor if an inexpensive implementation is to be achieved. Typical prior art WI coders require a large quantity of RAM to hold the REW and the SEW sequences for the temporal filtering and other operations—overall, about 6K words of RAM is needed by a typical conventional WI coder. Moreover, a large quantity of ROM—typically about 11K words—is needed for the LPC quantization.

D. Low-Complexity Waveform Interpolation Using Cubic Splines

The waveform interpolation process as performed in conventional WI coders and as described above is quite complex, partly because for every time instance, the full spectral vector needs to be interpolated and a DFT-type operation—e.g., the computation of equation (3) above—needs to be carried out. The non-regular sampling of the trigonometric functions, implied by equation (3), makes it even more complex since no simple recursive methods are useful for implementing these functions. To address this problem, the waveform interpolation process may be advantageously approximated by a much simpler method as follows. The spectra $\hat{S}(t_n,K)$ are first augmented to a fixed radix-2 size by zero-padding. An inverse Fast Fourier Transform (IFFT) is taken once per update to obtain time signals of fixed-size T. These signals are then transformed into cubic spline coefficient vectors. (Cubic spline coefficients, more completely described below, are familiar to those skilled in the signal processing arts.) Using these spline coefficients, samples of a continuous-time estimate of the signal can be generated at any desired point, which advantageously allows for a dynamic time-scaling as determined by the function c(t) of equation (1) above.

The use of a spline representation of a signal is a well-known technique for converting signals from discrete-time to continuous-time representations. (See, e.g., M. Unser et al., "B-Spline Signal Processing: Part I—Theory," IEEE Trans. on Sig. Proc. Vol. 41, No. 2, February 1993, pp. 821–833; M. Unser et al., "B-Spline Signal Processing: Part II—Efficient Design," IEEE Trans. on Sig. Proc. Vol. 41, No. 2, February 1993, pp. 834–848; and H. Hou et al., "Cubic Splines for Image Interpolation and Digital Filtering," IEEE Trans. on Acoust. Sp. & Sig. Proc. Vol. ASSP-26, No. 6, December 1978, pp. 508–517.) For band limited signals, it can be used in place of the far more expensive, infinite-support "sin(x)/x" filtering operation that perfectly reconstructs a continuous signal from its Nyquist sampled values.

As is familiar to those skilled in the signal processing arts, the k'th order spline representation of a signal s(t) is defined as $$s(t) = \sum_{n=-\infty}^{\infty} q_n B_k(t-n) \tag{6}$$

where $q_n$ are the spline coefficients and $B_k(t)$ is the spline continuous-time basis function, built of piecewise k'th order polynomials. One advantage of using a spline representation may be found in the fact that the basis function has a small finite support —specifically, it is non-zero only over a support of size k+1. This means that the summation of equation (6) actually needs to be performed over k+1 coefficients only —a significant saving in computational load (and memory) as compared to conventional band-limited filtering. The basis support is divided into k+1 sections at the time points t=n , where n=−k+1, . . . , k−1, referred to as nodes. The basis is symmetric with $B_k(0)=1$ and $B_k(t \geqq k-1)=0$. Thus, $B_k(t)$ is fully defined by assigning (k−1)'st order polynomials to the positive k−1 sections. The (k−1)(k+1) polynomial parameters may be resolved by imposing continuity conditions at the nodes. Specifically, the 0'th to (k−1)'st order derivatives of $B_k(t)$ are advantageously continuous at the nodes.

It is known to those skilled in the art that 3rd order splines (i.e., cubic splines) are sufficient for high-quality interpolation of most signals with very a low computational load. Therefore, cubic splines may be used in performing waveform interpolation in a low-complexity WI decoder. Applying the definition above to $B_3(t)$ (i.e., the cubic spline basis), it will be obvious to those skilled in the art that equation (6) can be put into a matrix form as follows:

$$s(t-n) = [(t-n)^3, (t-n)^2, t-n, 1] \begin{bmatrix} -1 & 3 & -3 & 1 \\ 3 & -6 & 3 & 0 \\ -3 & 0 & 3 & 0 \\ 1 & 4 & 1 & 0 \end{bmatrix} \begin{bmatrix} q_{n-1} \\ q_n \\ q_{n+1} \\ q_{n+2} \end{bmatrix} \tag{7}$$

where $n \leqq t \leqq n+1$. Let s(n) be a discrete-time sampled sequence of size N whose underlying continuous signal s(t) it is desired to estimate. It follows then from equation (7) above that for t=n, $$s(n)=q_{n-1}+4q_n+q_{n+1} \tag{8}$$

This defines the transform from the signal to the spline coefficients in a form of an IIR (infinite-impulse-response) filtering operation, familiar to those of ordinary skill in the art. This filter is non-causal and, therefore, care should be taken to implement it in a stable fashion. Also, a proper set of two initial conditions should be selected. As is familiar to those of ordinary skill in the art, one stable approach is to split the filtering into forward (causal) and backward (non-causal) operations. Equation (8) can be easily broken into two first order recursions using an auxiliary sequence $f_n$, and the stable pole of equation (8), namely, $p=2-\sqrt{3}$, as follows:

$$f_n=pf_{n-1}+s(n);n=0 \text{ to } N-1$$

$$q_n=p(f_n-q_{n+1});n=N-1 \text{ to } 0 \tag{9}$$

For a complete definition of this transformation, the initial values $f_{-1}$ and $q_n$ should be known. As such, in accordance with one illustrative low-complexity WI decoder, we let $f_{-1}=q_n=0$. Note that essentially any method for assigning these initial values may be used, but different methods yield different values for s(t), especially near the boundaries. Nonetheless, all of the resulting variants of s(t) advantageously yield the same sequence $s_n$ when sampled at t=n.

In accordance with another illustrative low-complexity WI decoder, another method for setting the initial conditions is employed. This method is based on assuming that s(n) is periodic with period N. Obviously, this implies that $q_n$ is also periodic. In this case, if the relation between s(n) and $q_n$ is expressed in the frequency domain by the DFT operation, the initial conditions are determined implicitly and no further care need be taken in this regard. Also, stability is of no concern in this case.

The DFT-domain filter H(K) associated with equation (8) may be obtained by computing the DFT of the sequence $$h_n=\begin{cases}4, & n=0\\ 1, & n=1\\ 1, & n=N-1\\ 0, & \text{otherwise}\end{cases} \tag{10}$$

that is, $H(K)=DFT\{h_n\}$. Similarly, $S(K)=DFT\{s(n)\}$ and $Q(K)=DFT\{q_n\}$. Thus, the DFT version of equation (8) is simply S(K)=H(K) Q(K). Defining the spline window as W(K)=1/H(K), we get the spline transform:

$$Q(K)=W(K)S(K) \tag{11}$$

Note that the complex window W(K) may be advantageously computed once off line and kept in ROM. Note also that the complexity of the transform is merely 3 operations per input sample, and that it is actually less then that of the time-domain counterpart as in equation (9), which requires 4 operations per input sample. However, to get the time-domain spline coefficients, an IDFT should be applied to Q(K). The data processed by the WI decoder is already given in the DFT domain—this is the signal $\hat{S}(t_0,K)$. Therefore, using W(K) for the spline transform is convenient. And the time-scale normalization required for the WI process may be conveniently performed by simply appending zeros to $\hat{S}(t_0, K)$ along the K'th axis. Moreover, the DFT may be advantageously augmented to a fixed radix-2 size N so that a fixed-size IFFT can be advantageously employed. The result of this IDFT is the spline coefficient sequence $q_n$ of size N.

In accordance with one illustrative low-complexity decoder, the final synthesis of the reconstructed speech signal may now be performed as follows. The cycle function c(t) is used to locate the sampling instants t in terms of fractions of the normalized cycle T=N. The four relevant spline coefficients implied by equation (7) are identified. These coefficients are interpolated with the corresponding coefficients from the spline vector of the previous update—i.e., the one obtained from $\hat{S}(t_{-1},K)$. Finally, using equation (7), the value s(t) is obtained. This process is advantageously repeated for enough values of t so as to fill the output signal update buffer. Note that c(t) preserves continuity across updates—namely, it increments from its last value from the previous update. However, this is performed modulo T, which is in line with the basic periodicity assumption.

Figure 3:
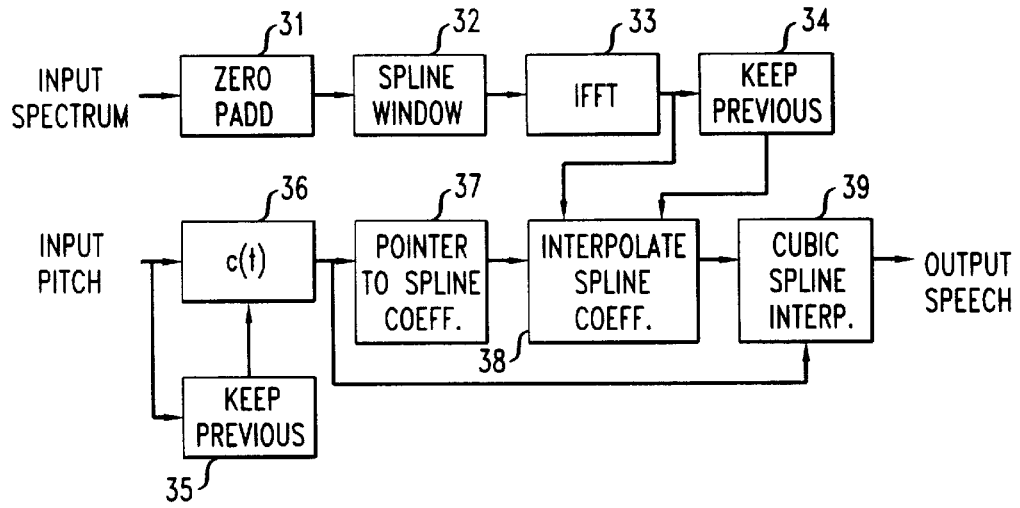
FIG. 3 shows a block diagram of waveform interpolation based on a cubic spline representation.

A block diagram of a first illustrative waveform interpolation process for use in a low-complexity WI coder is shown in FIG. 3. In particular, the illustrative WI process shown in FIG. 3 carries out waveform interpolation with use of cubic splines in accordance with the above description thereof. Specifically, block 31 pads the input spectrum with zeros to ensure a fixed radix-2 size. Then, block 32 takes the spline transform as described above, and block 33 performs the IFFT on the resultant data. Block 34 is used to store each resultant set of data so that the interpolation of the spline coefficients may be performed (by block 38) based upon the current and previous waveforms. Block 36 operates on the current input pitch value and the previous input pitch value (as stored by block 35) to perform the dynamic time scaling, and based thereupon, block 37 determines the spline coefficients to be interpolated by block 38. Finally, block 39 performs the cubic spline interpolation to produce the resultant output speech waveform (in the time domain).

E. Low-Complexity Waveform Interpolation Using Pseudo Cardinal Splines

In accordance with another illustrative low-complexity WI decoder, a variant of the above-described method further reduces the required computations by eliminating the use of the spline transform (i.e., the spline window). It is based on the notion of cardinal splines, familiar to those skilled in the signal processing arts and described, for example, in M. Unser et al., "B-Spline Signal Processing: Part I—Theory," cited above. The cardinal spline representation is obtained by imposing one additional condition on the basis function—namely, that it is strictly zero at the nodes: B(t)=0 for t=n and t≠0. As a result, it can no longer have a local finite support. Note, however, that its tails decay quickly, similar to that of the "sin(x)/x" function, discussed above. The pseudo cardinal splines used here in accordance with an illustrative low-complexity WI decoder are based on using a finite-support basis function that satisfies this additional condition with a relaxation of the other (i.e., the continuity) conditions. As in the above-described case using cubic splines, a 3rd order symmetric basis function over a support of $-2 \leqq t \leqq 2$ is used. One additional condition is imposed, however, namely, $$B_3(1)=B_3(-1)=0 \tag{12}$$

Therefore, only one continuity condition has to be given up. The second derivative is permitted to have an arbitrary value at the nodes t=−2 and t=2. Note that the basis function and its first derivative are zero at these points. Deriving the basis function under these conditions and expressing the interpolation operation in a matrix form gives:

$$s(t-n)= \tag{13}$$

$$[(t-n)^3, (t-n)^2, t-n, 1]\begin{bmatrix}-0.75 & 1.25 & -1.25 & 0.75\\ 1.50 & -2.25 & 1.50 & -0.75\\ -0.75 & 0.00 & 0.75 & 0.00\\ 0.00 & 1.00 & 0.00 & 0.00\end{bmatrix}\begin{bmatrix}q_{n-1}\\ q_n\\ q_{n+1}\\ q_{n+2}\end{bmatrix}$$

where $n \leqq t \leqq n+1$, which is the same as equation (7) except for the numerical values of the matrix. Setting t=0 (note the bottom row of the matrix) gives the relation between the input samples and the spline coefficients which is simply $$s(n)=q_n \tag{14}$$

That is, the input samples are the spline coefficients and, therefore, no further transformation is required. The complexity of the interpolator is as in the above-described embodiment, except that filtering and windowing are advantageously avoided. This saves three operations per sample, thereby reducing the decoder complexity even further. Also, note that no additional RAM is needed to store the current and previous spline coefficients and no additional ROM is needed to hold the spline window.

Note that the performance (i.e., in terms of the quality of the reconstructed speech signal) of an approach based on pseudo cardinal splines will likely be not as good as that of one based on regular cubic splines since pseudo cardinal splines are merely an approximation to the real cardinal splines. However, the level of distortion added to the data in the modeling and quantization process is typically far above the noise likely to be added by the use of a pseudo cardinal spline-based interpolator. Thus, the advantages of the reduced complexity outweigh the disadvantages of using such an approximation.

Figure 4:
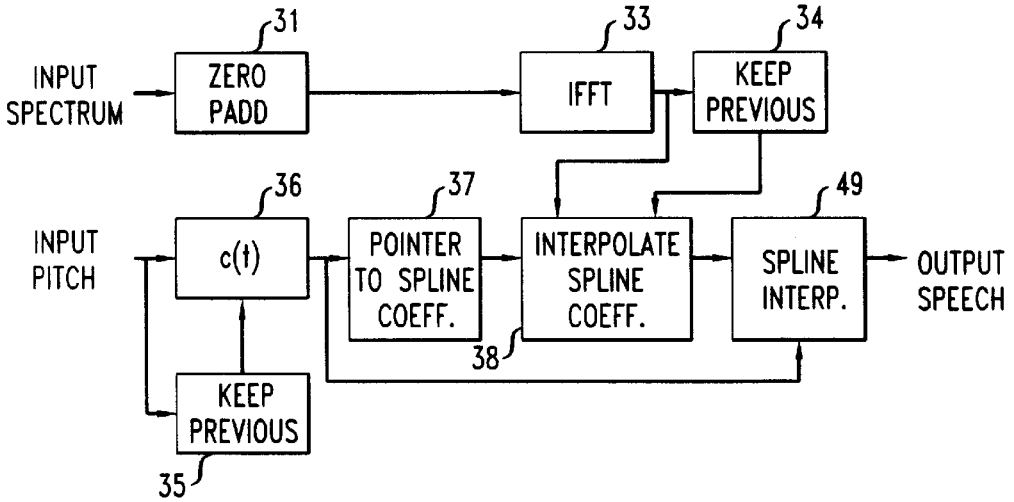
FIG. 4 shows a block diagram of waveform interpolation based on a pseudo cardinal spline representation.

A block diagram of a second illustrative waveform interpolation process for use in a low-complexity WI coder is shown in FIG. 4. In particular, the WI process shown in FIG. 4 carries out waveform interpolation with use of pseudo cardinal splines in accordance with the above description thereof. Specifically, the operation of the illustrative waveform interpolation process shown in FIG. 4 is similar to that of the illustrative waveform interpolation process shown in FIG. 3, except that the spline transformation (block 32) has become unnecessary and has therefore been removed, and the cubic spline interpolation (block 39) has been replaced by a pseudo cardinal spline interpolation (block 49).

F. Low-complexity Signal Decomposition

As noted above, the SEW/REW analysis requires parallel filtering of the spectra $R(t_n, K)$ for all the harmonic indices K. In conventional WI coders, this is typically performed with use of 20-tap filters. This is a major contributor to the overall complexity of prior art WI coders. Specifically, this process generates two sequences of spectra that need to be coded and transmitted—the SEW sequence and the REW sequence. While the SEW sequence can be down sampled prior to quantization, the REW needs to be quantized at full time and frequency resolution. However, at 2.4 kbps and lower coding rates, the typical bit budget (see above) is too small to produce a useful representation of the data. As an example of this problem, consider a pitch period of 80 samples and an update interval of approximately 12 msec. For a typical frame size of 25 msec., there are approximately 2 updates in each frame. Typically, only the magnitude DFT is quantized, so there are $(80/2)\times 2=80$ REW values in a frame to quantize. However, the bit budget allows for only 6 bits per frame (i.e., 3 bits per spectrum) for the REW quantizer—that is, 0.075 bits per component. Obviously, only a very rough approximation to the REW magnitude spectrum can possibly be transmitted in this case. Indeed, in the WI coder described in W. B. Kleijn et al., "A low-complexity waveform interpolation coder," cited above, the REW signal is drastically smoothed and parameterized into only 5 parameters using a polynomial curve fitting technique.

A similar situation exists for the SEW signal. Only 7 bits per frame are available according to the typical bit budget (see above). Therefore, only the SEW baseband spectrum of about 800 Hz is typically coded. The higher band is typically estimated assuming an overall flat LP spectrum, that is, $$\mathrm{SEW}(t,K)+\mathrm{REW}(t,K)=1 \tag{15}$$

This assumption regarding the flatness of the LP spectrum has been widely used in low-rate speech coding and, particularly, in WI-based coders. It is a reasonable assumption to make in the absence of bit resources—however, it is a gross under-representation of the LP spectrum, especially when the spectrum is taken over short frames, like in the typical WI coder case. The SEW signal and the REW signal are therefore severely distorted in the quantization process and not much of the signal characteristic is left from the original signal after coding.

Having recognized the existence of a substantial mismatch between the analysis (e.g., the decomposition) of the original residual signal and the quantization resolutions actually performed in typical WI coding environments, one illustrative embodiment of the present invention provides a much simpler analysis than that performed by prior art WI coders. In particular, it is recognized that it is unnecessary to perform a very expensive analysis at a very high resolution only to loose most of the information at the quantization stage. Since the performance of the coder is essentially dominated by the quantizer, a much simpler analysis can in theory be used. Thus, in accordance with an illustrative embodiment of the present invention, a new approach is taken to the task of signal decomposition and coding, changing the way the SEW and the REW are defined and processed.

1. Low-complexity signal decomposition of the unstructured component

In accordance with one illustrative embodiment of the present invention, the unstructured component of the residual signal is exposed by merely taking the difference between the properly aligned normalized current and previous spectra. This is essentially equivalent to simplifying the REW signal generation by replacing the 20th-order filter typically found in a conventional WI encoder with a first-order filter. In voiced speech, for example, this difference reflects an unstructured random component. It will be referred to herein as simply the random spectrum (RS). The RS's may be advantageously smoothed by a low-order (e.g., two or three) orthogonal polynomial expansion (using, e.g., three or four parameters per spectrum). It can be seen by examining typical smoothed SEW signals and typical smoothed RS's that both spectra are almost always monotonically increasing with frequency. In other words, the residual signal is invariably monotonically less structured in higher frequency bands. Given a bit allocation of only 3 bits to code each RS (see discussion of typical bit allocations above), only 8 such smoothed spectra can be used by the RS quantizer.

Figure 5:
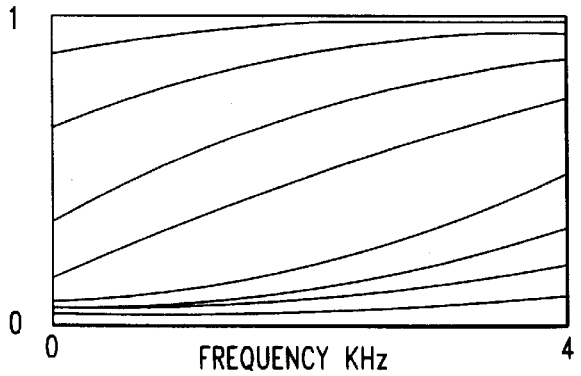
FIG. 5 shows an illustrative set of smoothed spectra for a random spectrum codebook of a waveform interpolation coder, in accordance with an illustrative embodiment of the present invention.

By training a 3-bit vector quantizer (VQ) in a conventional manner over a long sequence of smoothed RS's, a set of 8 codebook spectra can be generated. One such illustrative set of codebook spectra is shown in FIG. 5. In accordance with the illustrative embodiment of the present invention, smoothing and quantization can be combined during the coding process (as described, for example, in W. B. Kleijn et al., "A low-complexity waveform interpolation coder," cited above), by doing three full-size inner-products per vector. However, note that the constellation of the illustrative set of codebook spectra provides for an additional level of simplification. Specifically, since the curves shown in FIG. 5 are monotonically increasing with their indices, they can be pointed to uniquely based upon the areas under them, which is equivalent to their energies. Heuristically, this implies that a scalar parameter can be computed from the input data which can point to an entry in the RS codebook. In other words, a codebook entry (e.g., an illustrative curve from FIG. 5) represents a smoothed version of the magnitude difference of two aligned normalized spectra, $$RS(K)=|S_1(K)-s_2(k)| \tag{16}$$

consistent with the RS definition. The corresponding energy is $$E=\sum_K |S_1(K)-S_2(K)|^2 = 2-2\sum_K S_1(K)S_2^*(K) \tag{17}$$

where the last term can be identified as the square of the cross correlation between the corresponding time-domain signals. These signals are the properly aligned two successive snapshots of the input signal (i.e., the LP residual). If the update interval is approximately one pitch period in size, this cross-correlation is related to the pitch-lag correlation C(P) of the input, where P is the pitch period and C(.) is the standard correlation function. Therefore (ignoring the factor 2), the parameter $u=1-(C(P))^2$ is essentially used as an initial "soft index" to the codebook. Using a quantization table, u is advantageously mapped into an index in the range [0,7] which points to an RS curve (i.e., a codebook entry).

The above approach has four major advantages from the perspective of encoder complexity. First, no explicit high-resolution RS needs to be generated. Second, no alignment is needed. Third, no filtering is required. And fourth, no curve fitting is required. Note, however, that in accordance with this illustrative embodiment of the present invention, the pitch-lag correlation is found at the current update rate.

The parameter u as defined above reflects the level of "unvoicing" in the signal. Its temporal dynamics is predictable to a certain degree since it is consistently high in unvoiced regions and low in voiced ones. This can be efficiently utilized by applying VQ to consecutive values of this parameter. Thus, in accordance with another illustrative embodiment of the present invention, instead of directly quantizing the RS using 3 bits per vector, a 6-bit VQ may be advantageously used to quantize and transmit a u-vector within a frame. At the receiver, the decoded u-values may be mapped into a set of orthogonal polynomial parameters and a smoothed RS spectrum may be generated therefrom.

Note that the decoded RS represents a magnitude spectrum. The complete complex RS may, in accordance with an illustrative embodiment of the present invention, be obtained by adding a random phase spectrum, which is consistent with the presumption of an unstructured signal. The random phase may be obtained inexpensively by, for example, a random sampling of a phase table. Such an illustrative table holds 128 two-dimensional vectors of radius 1. An index to this table, I, where 0<I<128, may, for example, be generated pseudo-randomly by the C-language index recursion $$I=(\text{seed}=((++\text{seed})*17)\&4096)>>5 \tag{18}$$

which can be advantageously implemented by fast bitwise operations.

2. Low-complexity signal decomposition of the structured component

In typical WI coders the SEW signal is obtained by filtering each harmonic component of a sequence of properly aligned pitch-size spectra along the temporal axis using a 20-tap FIR (finite-impulse-response) lowpass filter. The filtered sequence is then decimated to one spectrum per frame. This is equivalent to taking a weighted average of these spectra once per frame. As noted earlier, both filtering and alignment may be advantageously avoided in accordance with certain illustrative embodiments of the present invention.

In certain illustrative embodiments of the present invention, the structured signal may be advantageously processed as follows. Given the pitch period P for the current frame, a new frame containing an integral number M of pitch periods is determined. Typically, the new frame overlaps the nominal frame. The pitch-size average spectrum, referred to herein as AS, may then be obtained by applying a DFT to this frame, decimating the MP-size spectrum by the factor M and normalizing the result. This approach advantageously eliminates the need for spectral alignment. To reduce the DFT complexity, the SEW-frame may be first upsampled to a radix-2 size N>MP, and then a Fast Fourier Transform (FFT) may be used. Note that this time scaling does not affect the size of the spectrum which is still equal to MP. The upsampling may, for example, be performed using cubic spline interpolation as described above.

The average spectrum, AS, may be viewed as a simplified version of the SEW using a simple filter. Unlike the REW and SEW signals generated by the conventional WI coder, AS(K) and (the unot generated by are not complementary, since they are not generated by two complementary filters. In fact, AS(K) by itself may be viewed as the current estimate of the LP magnitude spectrum. Therefore, the part of the spectrum which may be considered the structured spectrum (SS) is $$SS(K)=AS(K)-RS(K) \tag{19}$$

The bit budget of the WI coder as described above provides for only 7 bits for the coding of the AS. Since the lower frequencies of the LP residual are perceptually more important, only the baseband containing the lower 20% of the SEW spectrum is advantageously coded in accordance with an illustrative embodiment of the present invention. The rest of the AS magnitude spectrum may, for example, be presumed to be flat, with AS(K)=1.

Thus, the illustrative low-complexity coder codes the AS baseband and then transmits the coded result once per frame. The coding may be illustratively performed using a ten-dimensional 7-bit VQ of a variable dimension, D, where D is the lower of 0.2*P/2 or 10. If D<10, only the first D terms of the codevectors may be used. At the receiver, the AS baseband may be interpolated at the synthesis update rate and the SS(K) spectrum may be computed therefrom.

The magnitude spectrum SS(K) represents a periodic signal. Therefore, a fixed phase spectrum may be advantageously attached thereto so as to provide for some level of phase dispersion as observed in natural speech. This maintains periodicity while avoiding business. The phase spectrum, which may be derived from a real speaker, illustratively has 64 complex values of radius 1. It may be held in the same phase table used by the RS (the first 64 entries), thereby incurring no extra ROM. The resulting complex SS is illustratively combined with the complex RS to form the final quantized LP spectrum for the current update.

G. Update Rate Considerations

In conventional WI coding, the SEW and the REW can be generated and processed at any desired update rate independently of the current pitch. Moreover, the rates may be different in the encoder and decoder. If a fixed rate is used (e.g., a 2.5 msec. update interval), the data flow control is straightforward. However, since the spectrum size is, in fact, pitch dependent, so is the resulting computational load. Thus, at a fixed update rate, the complexity increases with the value of the pitch period. Since the maximum computational load is often of concern, it is advantageous to "equalize" the complexity. Therefore, in accordance with an illustrative embodiment of the present invention, in order to reduce the peak load, the update rate advantageously varies proportionally to the pitch frequency.

Note that for typical conventional WI encoders, the short-term spectral snapshots are processed at pitch cycle intervals. This is based on the assumption that for near-periodic speech it is sufficient to monitor the signal dynamics at a pitch rate. Such a variable sampling rate poses some difficulty at the SEW/REW signal filtering stage, which therefore calls for some special filtering procedure.

In the illustrative low-complexity WI (LCWI) encoder in accordance with the present invention however, such difficulties do not exist, since the AS is processed once per frame using a fixed size FFT. The RS is represented by the u-parameter which measures the changes at pitch intervals (i.e., the pitch-lag correlation) while being updated at a fixed rate.

In both conventional WI decoders and the illustrative LCWI decoder, the update rate is pitch dependent to equalize the load and to make sure the outcome is not overly periodic (i.e., the rate is too low). Moreover, the spline transform and the IFFT of the illustrative LCWI coder are made to be pitch dependent by rounding up the pitch value to the nearest radix-2 number. This advantageously reduces the variations in computational load across the pitch range. Thus, given the current pitch, an update rate control (URC) procedure may be advantageously employed to determine the synthesis sub-frame size over which the spectrum is reconstructed and the output signal is interpolated. Since the u-parameter is illustratively transmitted at a fixed rate (e.g., twice per frame), it may be interpolated at the decoder if a higher update rate is called for.

H. Low Complexity Quantization of the LP Parameters

In the illustrative LCWI coder, a low complexity vector quantizer (LCVQ) may be used in coding the LP parameters to further reduce the computational load. The illustrative LCVQ is based on that described in detail in J. Zhou et al., "Simple fast vector quantization of the line spectral frequencies," Proc. ICSLP'96, Vol. 2, pp. 945–948, October 1996, which is hereby incorporated by reference as if fully set forth herein. (Note that the illustrative LCVQ described herein is not necessarily specific to WI coders—it can also be advantageously used in other LP-based speech coders.)

In the illustrative LCVQ, the LP parameters are given in the form of 10 line spectral frequencies (LSF). The ten-dimensional LSF vectors are coded using 30 bits and 25 bits in the 1.2 kbps and 2.4 kbps coders, respectively. The LSF vector are commonly split into 3 sub-vectors since a full-size 25 or 30 bit VQ is not practically implementable. In particular, the sizes of the three LSF sub-vectors are (3, 3, 4) and (3, 4, 3) for the 1.2 kbps and 2.4 kbps coders, respectively. The number of bits assigned to the three sub-VQ's are (10, 10, 10) and (10, 10, 5), respectively. Each sub-VQ may comprise a full-search VQ, meaning that a global search is performed over 1024 (or 32) codevector candidates. However, in the illustrative LCWI coder in accordance with the present invention, the full-search VQ's are replaced by faster VQ's as described below.

Specifically, the illustrative fast VQ used herein is approximately 4 times faster than a full-search VQ. It uses the same optimally-trained codebook and achieves the same level of performance. In particular, it is based on the concept of classified VQ, familiar to those skilled in the art. The main codebook is partitioned into several sub-codebooks (classes). An incoming vector is first classified as belonging to a certain class. Then only that class and a few of its neighbors are searched. The classification stage is carried out by yet another small-size VQ whose entries point to their own classes. This codebook may be advantageously embedded in the main codebook so no additional memory locations are needed for the codevectors. However, some small increase (approximately 2%) in total memory may be required for holding the pointers to the classes.

I. An Illustrative Low-Complexity WI Coder

Figure 6:
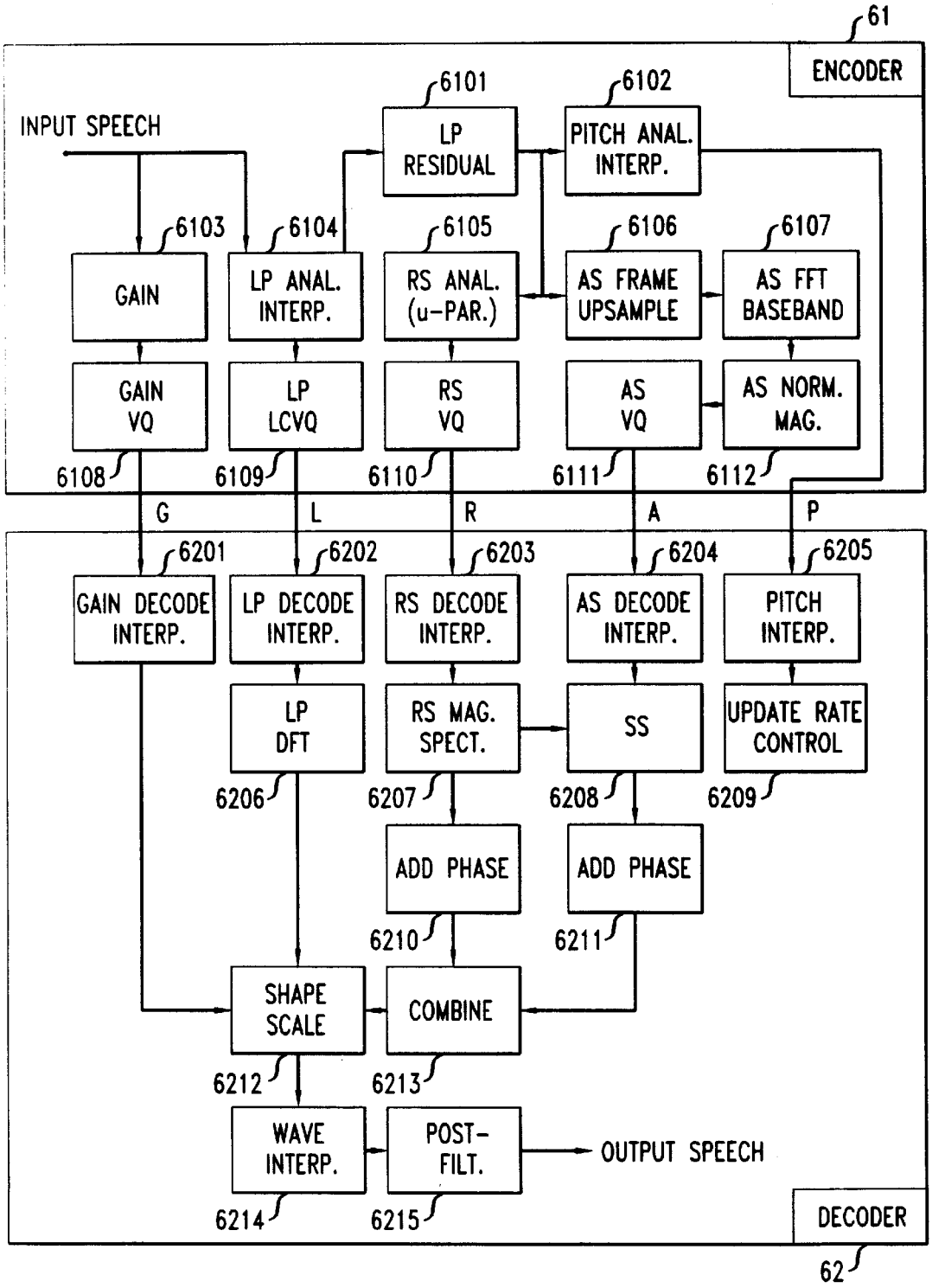
FIG. 6 shows a block diagram of a low-complexity waveform interpolation coder in accordance with an illustrative embodiment of the present invention.

FIG. 6 shows a block diagram of an LCWI coder in accordance with one illustrative embodiment of the present invention. Specifically, FIG. 6 shows encoder 61 with an illustrative block diagram thereof, decoder 62 with an illustrative block diagram thereof, and the illustrative data flow between the encoder and the decoder. In particular, the transmitted bit stream illustratively includes the indices of the quantized gain, LSF's, RS, AS and pitch, identified as G, L, R, A, and P, respectively.

1. An illustrative LCWI encoder

In the illustrative encoder shown in FIG. 6, an LP analysis is applied to the input speech (block 6104) and the LCVQ described above is used to code the LSF's (block 6109). The input speech gain is computed by block 6103 at a fixed rate of 4 times per frame. The gain is defined as the RMS of overlapping pitch-size subframes spaced uniformly within the main frame. This makes the gain contour very smooth in stationary voiced speech. If the pitch cycle is too short, two or more cycles may be used. This prevents skipping segments of possibly important gain cues. Four gains are coded as one gain vector per frame. For the illustrative 2.4 kbps version of the encoder, 10 bits are assigned to the gain. The gain vector is normalized by its RMS value called the "super gain". A two-stage LCVQ is used (block 6109). First the normalized vector is coded using a 6-bit VQ. Then, the logarithm (log) of the super-gain is coded differentially using a 4-bit quantizer. This coding technique increases the dynamic range of the quantizer and, at the same time, allows it to represent short-term (i.e., within a vector) changes in the gain, representing, for example, onsets. In the illustrative 1.2 kbps version of the encoder, no super-gain is used and a single 8-bit four-dimensional VQ is applied to the log-gains.

The input is inverse-filtered using the LP coefficients to get the LP residual (block 6101). Pitch detection is done on the residual to get the current pitch period (block 6102). The RS and the AS signals are processed as described above. In block 6105, u-coefficients are generated and in block 6110, the u-coefficients are coded by a two-dimensional VQ using 5 and 6 bits for the illustrative 1.2 and 2.4 kbps coders, respectively. In the illustrative 2.4 kbps coder, the AS baseband is coded by ten-dimensional VQ using 7 bits (blocks 6106, 6107, 6111, and 6112). In the 1.2 kbps coder, the AS is not processed and coded, but rather considered a constant—i.e., AS(K)=1, for all K. Therefore, blocks 6106, 6107, 6111, and 6112 in FIG. 6 do not exist in the illustrative 1.2 kbps coder.

2. An illustrative LCWI decoder

In the illustrative decoder shown in FIG. 6, the received pitch value is used by the update rate control (URC) in block 6209 to set the current update rate—that is, the number of sub-frames over which the entire interpolation and synthesis process is to be performed. The pitch is interpolated in block 6205 using the previous value and a value is assigned to each subframe.

In block 6201, the super gain is differentially decoded and exponentiated; the normalized gain vector is decoded and combined with the super gain; and the 4 gain values are interpolated into a longer vector, if requested by the URC. The LP coefficients are decoded once per frame and interpolated with the previous ones to obtain as many LP vectors as requested by the URC (block 6202). An LP spectrum is obtained by applying DFT 6206 to the LP vector. Note that this is advantageously a low-complexity DFT, since the input is only 10 samples. The DFT may be performed recursively to avoid expensive trigonometric functions. Alternatively, an FFT could be used in combination with a cubic-spline-based re-sampling.

In block 6203, the RS vector is decoded and interpolated if needed by the URC. Each u-value is mapped into an expansion parameter set and a smoothed magnitude RS is generated (block 6207). A random phase is attached in block 6210 to generate the complex RS.

In the illustrative 2.4 kbps coder, the AS is decoded and interpolated with the previous vector (block 6204). The SS magnitude spectrum is obtained in block 6208 by subtracting the RS, and then the SS phase is added in block 6211. The complex RS and SS data are combined (block 6213), and the result is shaped by the LP spectrum and scaled by the gain (block 6212). The result is applied to the waveform interpolation module (block 6214) which outputs the coded speech. The waveform interpolation module may comprise the illustrative waveform interpolation process of FIG. 3, the illustrative waveform interpolation process of FIG. 4, or any other waveform interpolation process.

Finally, a (preferably mild) post-filtering is applied in block 6215 to reshape the output coding noise. For example, an LP-based post-filter similar to the one described in J. H. Chen et al., "Adaptive postfiltering for quality enhancement of coded speech," IEEE Trans. Speech and Audio Processing, Vol. 3, 1995, pp. 59–71 may be used. Such a post-filter enhances the LP format pattern, thereby reducing the noise in between the formants. Alternatively, a post-filtering operation could be included in the LP shaping stage (i.e., in block 6212) as is done in the WI coder described in W. B. Kleijn et al., "A low-complexity waveform interpolation coder," cited above. However, to reduce the overall noise, including that of the cubic-spline interpolator, the post-filter is preferably placed at the end of synthesis process as shown in the illustrative embodiment of FIG. 6.

J. Addendum

For clarity of explanation, the illustrative embodiment of the present invention has been presented as comprising individual functional blocks (including functional blocks labeled as "processors"). The functions these blocks represent may be provided through the use of either shared or dedicated hardware, including, but not limited to, hardware capable of executing software. For example, the functions of processors presented herein may be provided by a single shared processor or by a plurality of individual processors. Moreover, use of the term "processor" herein should not be construed to refer exclusively to hardware capable of executing software. Illustrative embodiments may comprise digital signal processor (DSP) hardware, such as Lucent Technologies' DSP16 or DSP32C, read-only memory (ROM) for storing software performing the operations discussed below, and random access memory (RAM) for storing DSP results. Very large scale integration (VLSI) hardware embodiments, as well as custom VLSI circuitry in combination with a general purpose DSP circuit, may also be provided. Any and all of these embodiments may be deemed to fall within the meaning of the word "processor" as used herein.

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention.

I claim:

1. A method of coding a speech signal, the speech signal having a sequence of time-ordered short-term spectra corresponding thereto, the method comprising the steps of:

identifying a time-ordered sequence of speech signal segments;

generating a time-ordered sequence of sets of frequency-domain parameters based on samples of the speech signal;

performing a cross correlation between two or more of said speech signal segments to generate one or more parameters representing relatively high rates of evolution of said short-term spectra;

generating one or more sets of coefficients representing relatively low rates of evolution of said short-term spectra based on two or more of said sets of frequency-domain parameters; and coding said speech signal based on the one or more generated parameters and further based on the one or more sets of coefficients representing relatively low rates of evolution of said short-term spectra.

2. The method of claim 1 wherein the step of coding the speech signal comprises selecting a codebook entry from a fixed codebook containing a plurality of codebook entries representing a corresponding plurality of magnitude spectra.

3. The method of claim 2 wherein each of the magnitude spectra in the codebook represents a magnitude difference of a first spectrum based on a first set of time-domain parameters and a second spectrum based on a second set of time-domain parameters.

4. The method of claim 2 wherein each of the codebook entries has an associated codebook index, and wherein the plurality of magnitude spectra are monotonically increasing with respect to the codebook indices associated therewith.

5. The method of claim 4 wherein the step of performing the cross correlation comprises generating one of said associated codebook indices, and wherein the step of coding the speech signal comprises selecting the codebook entry corresponding to the generated codebook index.

6. The method of claim 4 wherein the step of performing the cross correlation comprises generating a vector of soft index values, each soft index value corresponding to a magnitude spectrum, and wherein the step of coding the speech signal comprises performing a vector quantization on said vector of soft index values.

7. The method of claim 1 wherein each of the speech signal segments are substantially equal to a pitch-period in length.

8. The method of claim 1 wherein the speech signal comprises an LP residual signal.

9. The method of claim 1 wherein the step of generating the sets of frequency-domain parameters comprises performing a Fourier transform.

10. The method of claim 1 wherein the step of coding the speech signal comprises performing vector quantization on the one or more sets of coefficients representing relatively low rates of evolution of said short-term spectra.

11. An encoder for coding a speech signal, the speech signal having a sequence of time-ordered short-term spectra corresponding thereto, the encoder comprising:

means for identifying a time-ordered sequence of speech signal segments;

means for generating a time-ordered sequence of sets of frequency-domain parameters based on samples of the speech signal;

means for performing a cross correlation between two or more of said speech signal segments to generate one or more parameters representing relatively high rates of evolution of said short-term spectra;

means for generating one or more sets of coefficients representing relatively low rates of evolution of said short-term spectra based on two or more of said sets of frequency-domain parameters; and means for coding said speech signal based on the one or more generated parameters and further based on the one or more sets of coefficients representing relatively low rates of evolution of said short-term spectra.

12. The encoder of claim 11 wherein the means for coding the speech signal comprises means for selecting a codebook entry from a fixed codebook containing a plurality of codebook entries representing a corresponding plurality of magnitude spectra.

13. The encoder of claim 12 wherein each of the magnitude spectra in the codebook represents a magnitude difference of a first spectrum based on a first set of time-domain parameters and a second spectrum based on a second set of time-domain parameters.

14. The encoder of claim 12 wherein each of the codebook entries has an associated codebook index, and wherein the plurality of magnitude spectra are monotonically increasing with respect to the codebook indices associated therewith.

15. The encoder of claim 14 wherein the means for performing the cross correlation comprises means for generating one of said associated codebook indices, and wherein the means for coding the speech signal comprises means for selecting the codebook entry corresponding to the generated codebook index.

16. The encoder of claim 14 wherein the means for performing the cross correlation comprises means for generating a vector of soft index values, each soft index value corresponding to a magnitude spectrum, and wherein the means for coding the speech signal comprises means for performing a vector quantization on said vector of soft index values.

17. The encoder of claim 11 wherein each of the speech signal segments are substantially equal to a pitch-period in length.

18. The encoder of claim 11 wherein the speech signal comprises an LP residual signal.

19. The encoder of claim 11 wherein the means for generating the sets of frequency-domain parameters comprises means for performing a Fourier transform.

20. The encoder of claim 11 wherein the means for coding the speech signal comprises means for performing vector quantization on the one or more sets of coefficients representing relatively low rates of evolution of said short term spectra.

* * * * *